US006317997B1

(12) United States Patent
Kooznetsoff et al.

(10) Patent No.: US 6,317,997 B1
(45) Date of Patent: Nov. 20, 2001

(54) VACUUM PORT POSITIONING FOR VACUUM DRYING SYSTEMS

(75) Inventors: Gary Kenneth Kooznetsoff; Robert Lewis Zwick, both of Castlegar (CA)

(73) Assignee: HeatWave Drying Systems Ltd, Crescent Valley (CA)

( * ) Notice: Subject to any disclaimer, the term of this patent is extended or adjusted under 35 U.S.C. 154(b) by 0 days.

(21) Appl. No.: 09/691,148

(22) Filed: Oct. 19, 2000

(51) Int. Cl.[7] ..... F26B 13/30
(52) U.S. Cl. ..... 34/92
(58) Field of Search ..... 34/92, 202, 204, 34/231, 76, 77, 396; 219/220

(56) References Cited

U.S. PATENT DOCUMENTS

| | | | | |
|---|---|---|---|---|
| 1,672,326 | * | 6/1928 | Kobiole | 422/28 |
| 3,283,412 | * | 11/1966 | Farnsworth | 34/287 |
| 3,574,949 | * | 4/1971 | Farnsworth | 34/407 |
| 3,986,268 | | 10/1976 | Koppelman . | |
| 4,194,296 | * | 3/1980 | Pagnozzi et al. | 34/410 |
| 4,343,095 | * | 8/1982 | Rosen et al. | 34/411 |
| 4,466,198 | * | 8/1984 | Doll | 34/257 |
| 5,228,209 | * | 7/1993 | Brunner | 34/417 |

FOREIGN PATENT DOCUMENTS

| | | |
|---|---|---|
| 4121578 | 4/1992 | (JP) . |
| WO99/18401 | 4/1999 | (WO) . |

* cited by examiner

*Primary Examiner*—Teresa Walberg
*Assistant Examiner*—Vinod D. Patel
(74) *Attorney, Agent, or Firm*—C. A. Rowley

(57) ABSTRACT

A vacuum drying system wherein the drying chamber is provided with at least two vacuum draw headers positioned one above and one below a median plane through a load being dried to draw gases substantially symmetrically from opposite sides of the load as it is being dried. Preferably the drying system is a dielectric drying system and headers are positioned on opposite sides of the load.

40 Claims, 3 Drawing Sheets

VACUUM PORT POSITIONING FOR VACUUM DRYING SYSTEMS

FIELD OF INVENTION

The present invention relates to a vacuum drying system with improved vacuum draw positioning relative to the load, more particularly to a radio frequency (RF) vacuum drying (RFVD) system incorporating improved vacuum draw positioning relative to the load.

BACKGROUND OF THE INVENTION

Dielectric drying systems are known and are currently in use or have been proposed for use in agriculture, polymer manufacture, pharmaceuticals, bulk powder, food processing, wood products, and other industries. One of the key industries using these dielectric drying systems is the wood products industry and the present invention will be described particularly with respect to the wood products industry although the invention, with suitable modifications where required, may be applied in the other industries in which dielectric drying is to be performed.

In dielectric drying systems (particularly those for drying wood of the type described in U.S. Pat. No. 3,968,268 issued Oct. 19, 1976 to Koppelman), it is conventional practice for the lumber to be moved into the drying chamber, at least one power electrode that will emit electromagnetic energy to a grounding electrode to complete the circuit is positioned near or in contact with the load. After the load has been positioned in the kiln, the kiln chamber is closed and the drying process is commenced by applying a negative pressure in the chamber and applying RF power (energy) to the load through the power electrode(s). In the arrangement shown in this patent, two vacuum draw headers are provided through the top of the kiln with one adjacent to each longitudinal end of the kiln.

WO 99/18401 published Apr. 15, 1999 inventor Wolf discloses a kiln with vertical electrodes similar to Koppelman and once Wolf draws the chamber down to the operating pressure used for drying, he applies vacuum at a single point on the side of the load positioned behind one of the electrodes.

Japanese patent JP4121578 published Apr. 22 1992 inventor Nishihama also discloses the use of vacuum connections one through the roof and a second through the floor, the one through the floor is referred to as sucking a part of the drain from the bottom.

In dielectric drying systems of which the Applicants are aware in the wood products industry, vacuum is drawn from one or two vacuum headers, positioned on top of the chamber (see for example the vacuum headers described in the above Koppelman patent). The belief in the industry prior to the present invention was that vacuum draw location from the chamber was irrelevant to the operation of dielectric vacuum drying processes such as radio frequency vacuum drying (RFVD).

BRIEF DESCRIPTION OF THE PRESENT INVENTION

It is an object of the present invention to provide an improved dielectric vacuum drying system that attains more uniform drying of the product being dried.

More specifically, it is an object to provide a vacuum draw system to improve the drying uniformity of the dried product.

Broadly, the present invention relates to vacuum drying system comprising a sealable drying chamber, vacuum draw means for withdrawing gases and vapors from said drying chamber during drying a load, the improvement comprising at least two vacuum draw outlet headers composed of an upper outlet header positioned to withdraw said gases and vapors preferentially from above a substantially horizontal medial plane of said load in drying position in said chamber and at least one lower outlet header positioned to withdraw said gases and vapors preferentially from below said medial plane of said load, said lower header being positioned above the a bottom of said drying chamber.

Preferably vacuum drying system is a dielectric and includes a pair of horizontal opposed electrodes for applying dielectric power to said load.

Preferably, said system is constructed so that said upper vacuum outlet header draws more gases from said drying chamber than said lower vacuum outlet header.

Preferably each said outlet header extends at least along 20% of a longitudinal length of said electrodes.

Preferably each said header extends along at least 70% of said longitudinal length of said electrodes.

Preferably at least two vacuum draw outlets comprise a first pair of said upper and lower outlet headers on one longitudinal side of said load and a second pair of said upper and lower outlet headers on a second longitudinal side of load opposite said first longitudinal side.

Preferably each said upper outlet is positioned within an upper third of a distance separating said electrodes when said electrodes are in operative position for drying said load and each said lower outlet headers are positioned within a lower third of said distance separating said electrodes when said electrodes are in operative position.

Preferably said upper and lower vacuum outlet headers are symmetrically positioned relative to the center of said load.

Preferably said dielectric vacuum drying comprises radio frequency vacuum drying (RFVD).

BRIEF DESCRIPTION OF THE SEVERAL VIEWS OF THE DRAWING(S)

Further features, objects and advantages will be evident from the following detailed description of the preferred embodiments of the present invention taken in conjunction with the accompanying drawings in which.

Figure 3:
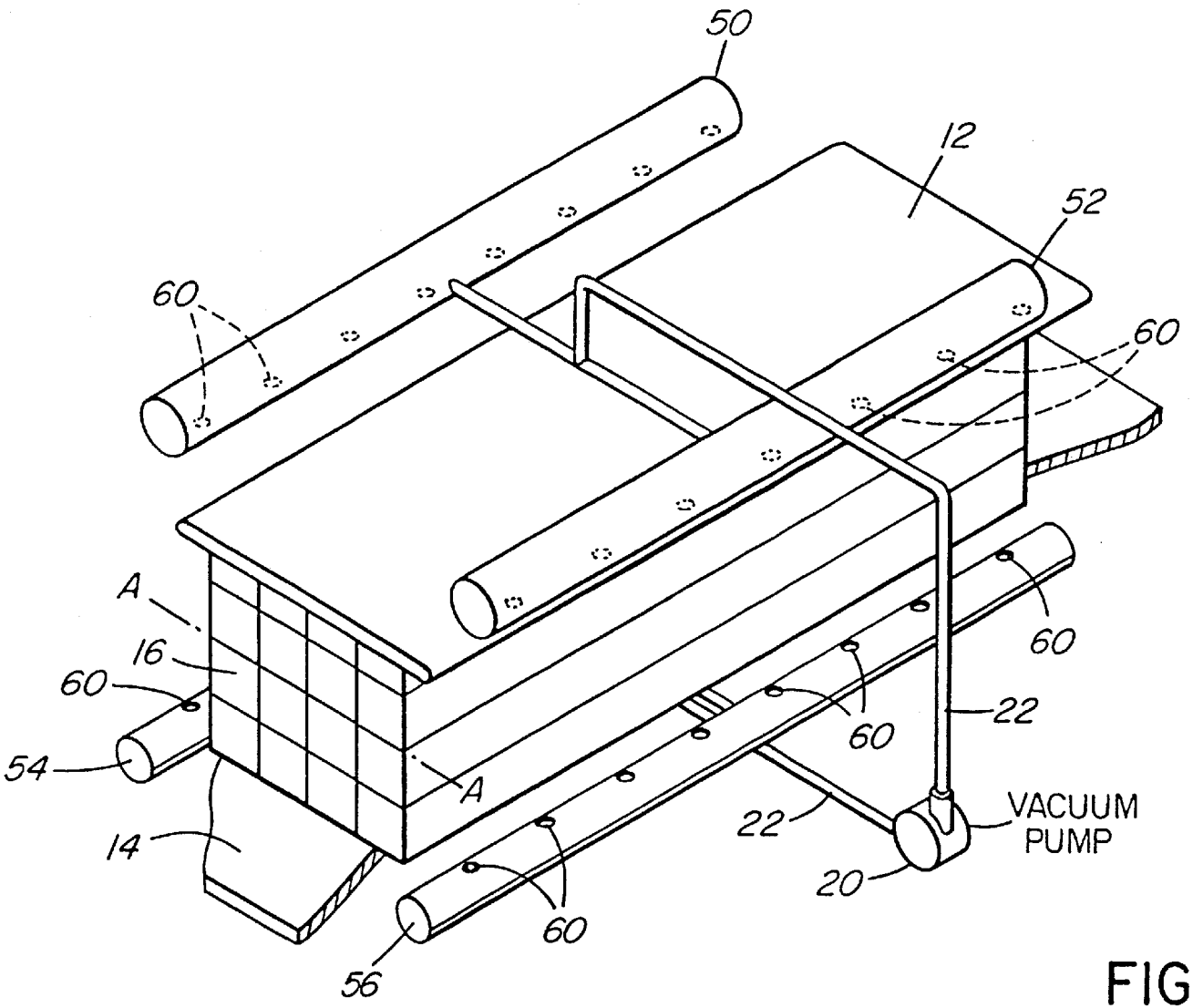

FIG. 3 schematically illustrates a preferred form of vacuum draw headers for use with the present invention.

DETAILED DESCRIPTION OF THE INVENTION

Analysis of drying trials in a drying kiln having relatively high uniformity of electric field density through the load showed there were often still some wet spots/layers running in completely different directions to what was expected if there were electric field non-uniformity issues. It was eventually concluded that the wet spots could not have anything to do with RF field uniformity, which led to further investigation. It became clear that the vacuum port was on the side and very often there were significant wet spots near the vacuum port.

The vacuum draw was then repositioned to draw from a single location at the top of the chamber (following what RFV manufacturers had been doing for decades). For the first time to Applicants' knowledge, a statistically significant moisture gradient was found to extend from top to bottom (top was dryer than the bottom).

As a further test of the hypothesis that location of the vacuum port is important, the vacuum port was positioned to be just below the floor of the chamber to withdraw gases and vapors only from below the perforated bottom ground floor. A much more statistically significant moisture gradient was found from top to bottom (this time the bottom was noticeably dryer than the top).

Next two vacuum ports were tried; one above and one below the load so gases and vapors were sucked from both the bottom and the top of the chamber. This further modification of the vacuum draw significantly improved the average drying uniformity in the top-to-bottom direction.

From these tests, it was determined that to obtain improved drying uniformity it is necessary to position the vacuum ports or outlets so that gases from within the kiln are effectively withdrawn (on average substantially equally) from both sides of the load and that the gases remain sufficiently diffused to prevent the formation of wet spot(s) on the load which the Applicants have found also requires separately withdrawing gases from above a medial plane of the load (i.e. medial plane between the electrodes when the electrodes are in operative position or in other arrangements mid height of the load being dried) and from below the medial plane.

One of the intentions of this invention is to uniformly diffuse or draw the water vapor away from the load of wood (a high relative humidity (RH) environment). It is believed that philosophy of this invention could also be applied to improving uniformity of superheated stream vacuum (SSV) drying although in this situation, it can be more difficult since SSV kilns employ convective drying and the localized RH conditions are more difficult to control.

In this application, the Applicants use the term "diffused" to mean that the vacuum draw is sufficiently distributed within the drying chamber so that all exposed surfaces of the drying product are affected by nearly the same flow rate of gases and vapor.

Figure 1:
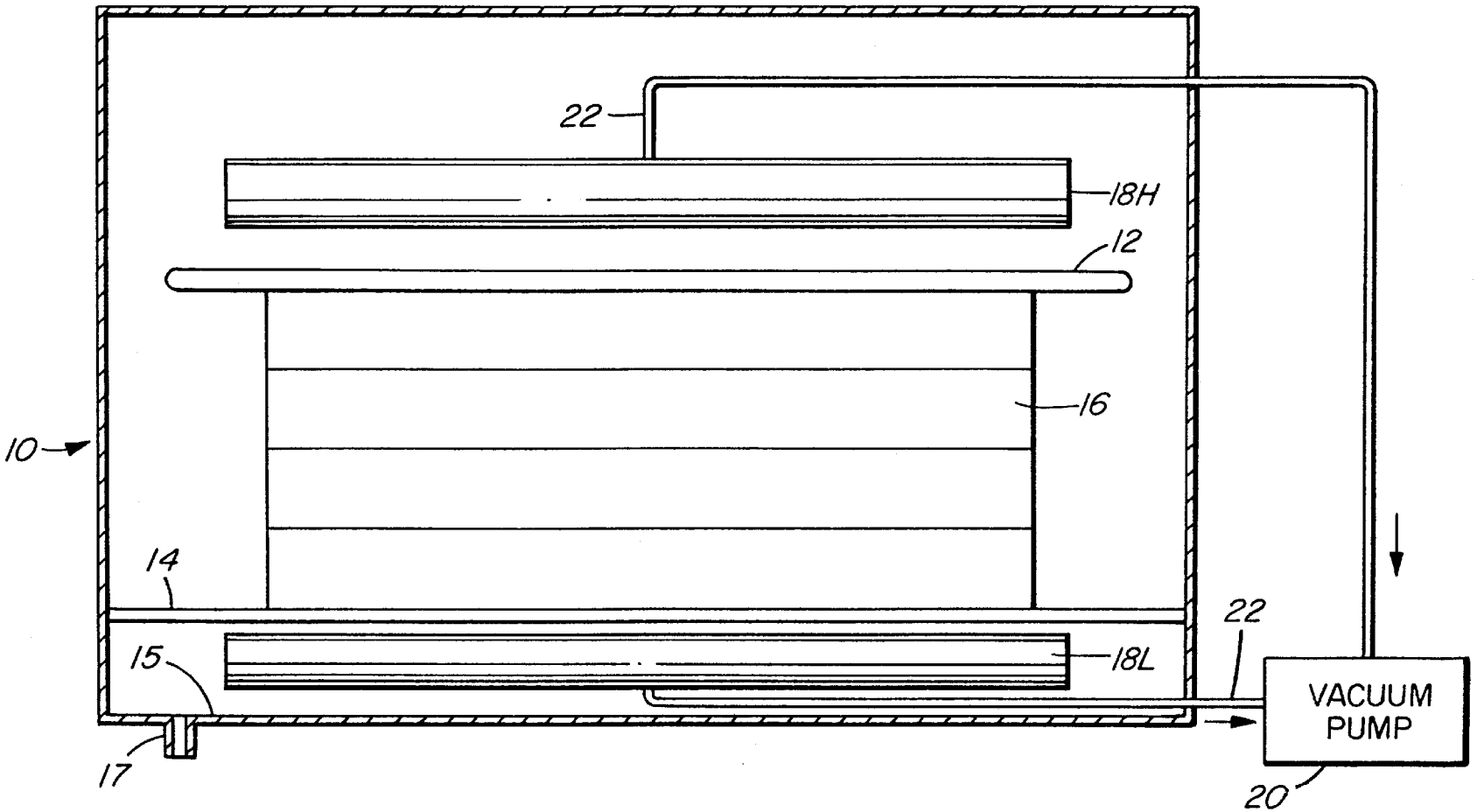
FIG. 1 is a schematic illustration of a dielectric drying kiln incorporating the features of the present invention.

Turning to FIG. 1, a drying kiln 10 incorporating the present invention is schematically illustrated. The kiln 10 is provided with a pair of opposed electrodes 12 and 14 for applying energy to the load 16 which is received therebetween and incorporates a plurality of vacuum draw ports preferably in the form of headers strategically positioned within the chamber 10 and around the load 16 as will be described in more detail hereinbelow.

Vacuum is applied via a suitable vacuum pump schematically indicated at 20, which is connected to the vacuum headers 18U and 18L via suitable vacuum lines 22. Such a system also generally requires suitable vapor condensing equipment (not shown).

Generally the Applicants have found that positioning one or more vacuum headers 18U above the medial plane A—A of the load 16 (i.e. the medial plane between the electrodes 12 and 14 when the electrodes are in operative position drying the load) and one or more below 18L as shown in FIG. 1 produces significant improvement over all previously used vacuum port configurations. The preferred positioning of the headers 18U and 18L will be described in more detail below. The headers are normally positioned to draw symmetrically from opposite sides of the load 16.

The headers 18U and 18L are preferably positioned axially relative to the load 16 so that they are at about mid length of the load 16. The headers 18U and 18L are positioned to draw substantially equally from opposite sides of the load and are spaced away from the sides of the load so that any potential increased concentration of gases that may tend to occur as the gases are brought closer together to leave through the header 18U and/or 18U are effectively removed from the load.

The headers 18U and 18L will preferably extend symmetrically relative to the vertical center line of the load for preferably substantially the full axial length (horizontally) of the load 16, but shorter lengths for example at least 70% of the axial length of the load may also be used and for short loads the length of the header 18U and 18L may be reduced to a single outlet, but generally will not be less than about 20% of the axial length of the load 16.

It is preferred that the upper header(s) 18U be capable of withdrawing more gases than the lower headers 18L since the vapors tend to rise. This may be accomplished by applying more vacuum to the upper than the lower headers by valving, but preferably is attained by providing less resistance to flow into the upper header 18U than the lower header 18L by for example increasing the number of perforations in the upper headers 18U. It is preferred to construct the system to withdraw about twice as much vapor or gas via the upper header(s) 18U than via the lower header(s) 18L. In some cases the amount of gases withdrawn through the lower header(s) may be equal to or greater than the amount withdraw through the upper headers and still provide improvement over conventional vacuum draw systems, but normally the upper headers will be designed to withdraw more of the gases The perforation or apertures 60 (see FIGS. 2 and 3) in the headers 18U and 18L will normally be spaced along the headers to apply uniform vacuum [flow] to the load along the length of the headers 18U and 18L.

The bottom header is normally positioned above the floor 15 of the kiln 10 and a separate drain 17 is provided to drain any condensate or other liquid that tends to accumulate on the floor 15.

Figure 2:
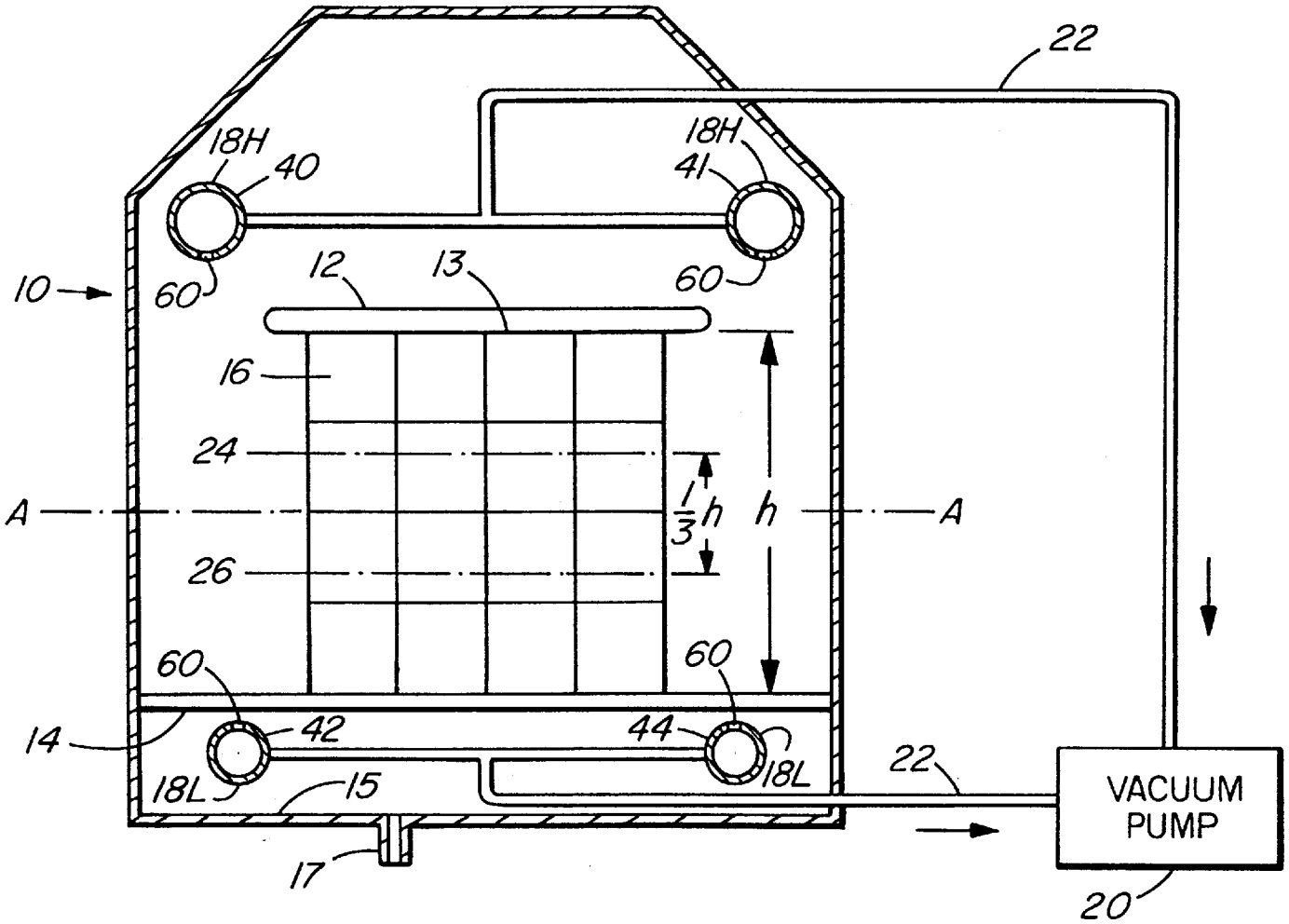
FIG. 2 is a cross section showing the medial plane of the load or of the spacing between the electrodes when in operative position drying a load.

In the arrangement shown in FIG. 2, a pair of top vacuum headers 18U are formed by perforated pipes 40 and 41 and a pair of bottom vacuum headers 18B are formed by perforated pipes 42 and 44 positioned one on each side of the load and extending along the sides of the load, to withdraw gases upwardly and downwardly. Substantially equal amounts of gas are preferably withdrawn from each side of the load 16.

The preferred arrangement of vacuum draw headers is shown in FIG. 3. In this arrangement, four perforated pipes or headers 50, 52, 54 and 56 are shown symmetrically positioned around the load 16. The top headers 50 and 52 form the upper vacuum headers 18U and the lower headers 54 and 56 the lower vacuum headers 18L. Vacuum is provided by the pump 20 through suitable ducts 22 to each of the headers 50, 52, 54 and 56. It will be apparent that more than four headers may be provided it being important as above indicated to effectively withdrawn (on average substantially equally) gases from both sides of the load and that the gases remain sufficiently diffused to prevent the formation of wet spot(s) on the load.

As illustrated in FIG. 3, there is a pair of upper and lower vacuum outlets 18U and 18L on each side of the load 16 i.e. headers 50 and 54 on the left side of the load and 52 and 56 on the right side of the load 16.

The headers 18U (upper headers 40 and 41 and 50 and 52) when radio frequency drying (RED) is used are preferably positioned spaced at least ⅓ the height h of the load above the medial plane A—A as indicated by the plane 24 (see FIG. 2) and the lower vacuum outlets or draws 18L (lower headers 42 and 44 and 54 and 56) are preferably positioned spaced at least ⅓ the height h of the load below the medial plane A—A as indicated by the plane 26 (see FIG. 2).

Each of the headers 40, 41, 42, 44, 50, 52, 54 and 56 is spaced from the load a distance sufficient to ensure the vacuum applied is spread over a significant area of the load (not so close as to create concentrated vacuum draw in small discrete areas) i.e. generally no closer than about 1 foot from the load 16 i.e. so that the air flow away from the load is dispersed. The purpose of the vacuum headers is not only to remove vapors being generated from the wood, but to also pull the vapor away from the wood so as to minimize the formation of wet spots on the wood by condensation or another mechanism such as moisture migration to the wood surface.

In a specific example of the invention applied to a kiln of about 165 cu. meters total interior chamber volume with a maximum load volume of 30 cu. meters, the vacuum flow was about 13 cubic meters per minute. Cylindrical-shaped headers were symmetrically positioned relative to the load 16 and extend the length of the electrode 12 and each header had a cross sectional area of approximately 46 square centimeters (sq. cm) and the total cross sectional area of the approximately 120 perforations 60 in the headers 50, 52, 54 and 56 was approximately 38 square centimeters. In this particular embodiment the perforations were 0.75 cm in diameter and were positioned 30 cm apart for the full length of the intake headers.

The shape of the perforations 60 is not critical, and may be any suitable shape for example a circular perforation (FIG. 3) or a slot (FIG. 2)—even a continuous slot extending the length of the header. The sizes of the perforations (or slot(s)) 60 or their distribution need not be uniform; for example, some perforations or slots 60 may have significantly larger cross sectional areas than others and/or some perforations (or slot(s)) 60 may be much closer to one another than others. It is however important to coordinate the size and positions of the perforations 60 relative to the load 16 and relative to any preceding perforations (or slot(s)) in the header to ensure the flow to the header from the load remains diffused and so that essentially the same vapor flow/vacuum conditions are applied over the surface of the kiln charge of lumber.

Depending on the pressure losses before a particular hole, the the flow through that hole can be significantly reduced in comparison to a hole nearer the source i.e. at higher pressure. Therefore it was concluded that to maintain uniform vacuum diffusion along the header/along the load, the area of the perforation holes and location of the holes be coordinated with the pressure in the header at the hole location to obtain the desired flow through the perforations Generally the total area of the holes will be less than the total crosssection of the header.

It is also possible, but not preferred, to combine the upper and lower vacuum outlet headers 18U and 18L to provide a first combined header extending along the medial plane between said electrodes 12 and 14 on one longitudinal side of said load 16 and a second combined header extending along the medial plane between said electrodes 12 and 14 on the opposite longitudinal side of said load 16 being dried. Each of the combined headers will have upper openings to withdraw said gases and vapors preferentially from above the medial plane and lower openings to withdraw said gases and vapors preferentially from belo w the medial plane.

A vacuum header could be built into the electrode(s) by making the electrode hollow and provide perforations facing the load. Such a structure would more likely be applied to form an upper header as opposed to a lower header.

The headers have been shown as continuous length headers, but if desired each illustrated header could be made of a plurality of shorter headers each shorter header connected to a source of vacuum and preferably, but not necessarily the shorter headers used to replace one of the illustrated headers will be arranged axially spaced along a common longitudinal axis.

It will be evident to those skilled in the art of vacuum drying that this invention will also likely be beneficial to non-dielectric batch vacuum drying processes of equal or larger volumes of typical RFVD applications.

Having described the invention, modifications will be evident to those skilled in the art without departing from the scope of the invention as defined in the appended claims.

We claim:

1. A vacuum drying system comprising a sealable drying chamber, vacuum draw means for withdrawing gases and vapors from said drying chamber during drying a load, the improvement comprising at least two vacuum draw outlet headers composed of an upper vacuum outlet header positioned to withdraw said gases and vapors preferentially from above a substantially horizontal medial plane of said load in drying position in said chamber and at least one lower vacuum outlet header positioned to withdraw said gases and vapors preferentially from below said medial plane of said load, said lower header being positioned above the a bottom of said drying chamber.

2. A vacuum drying system as defined in claim 1 wherein said system is constructed so that said upper vacuum outlet header draws more gases from said drying chamber than said lower vacuum outlet header.

3. A vacuum drying system as defined in claim 2 wherein said vacuum drying system is a dielectric and includes a pair of horizontal opposed electrodes for applying dielectric power to said load.

4. A vacuum drying system as defined in claim 3 wherein each said header extends at least along 20% of a longitudinal length of said electrodes.

5. A vacuum drying system as defined in claim 4 wherein said at least two vacuum draw outlet headers comprises a first pair of upper and lower outlet headers on one longitudinal side of said load and a second pair of said upper and lower outlet headers on a second longitudinal side of load opposite said first longitudinal side.

6. A vacuum drying system as defined in claim 5 wherein said upper and lower vacuum outlets are symmetrically positioned relative to the center of said load.

7. A vacuum drying system as defined in claim 4 wherein said upper and lower vacuum outlets are symmetrically positioned relative to the center of said load.

8. A vacuum drying system as defined in claim 3 wherein each said header extends along at least 70% of said longitudinal length of said electrodes.

9. A vacuum drying system as defined in claim 8 wherein said at least two vacuum draw outlet headers comprises a first pair of upper and lower outlet headers on one longitudinal side of said load and a second pair of said upper and lower outlet headers on a second longitudinal side of load opposite said first longitudinal side.

10. A vacuum drying system as defined in claim 9 wherein said upper and lower vacuum outlets are symmetrically positioned relative to the center of said load.

11. A vacuum drying system as defined in claim 8 wherein said upper and lower vacuum outlets are symmetrically positioned relative to the center of said load.

12. A vacuum drying system as defined in claim 3 wherein said at least two vacuum draw outlet headers comprises a first pair of upper and lower outlet headers on one longitudinal side of said load and a second pair of said upper and lower outlet headers on a second longitudinal side of load opposite said first longitudinal side.

13. A vacuum drying system as defined in claim 12 wherein said upper and lower vacuum outlets are symmetrically positioned relative to the center of said load.

14. A vacuum drying system as defined in claim 3 wherein each said upper outlet headers is positioned within an upper third of a distance separating said electrodes when said electrodes are in operative position for drying said load and each said lower outlet headers are positioned within a lower third of said distance separating said electrodes when said electrodes are in operative position.

15. A vacuum drying system as defined in claim 14 wherein said upper and lower vacuum outlets are symmetrically positioned relative to the center of said load.

16. A vacuum drying system as defined in claim 3 wherein said upper and lower vacuum outlets are symmetrically positioned relative to the center of said load.

17. A vacuum drying system as defined in claim 2 wherein said at least two vacuum draw outlet headers comprises a first pair of upper and lower outlet headers on one longitudinal side of said load and a second pair of said upper and lower outlet headers on a second longitudinal side of load opposite said first longitudinal side.

18. A vacuum drying system as defined in claim 17 wherein said upper and lower vacuum outlets are symmetrically positioned relative to the center of said load.

19. A vacuum drying system as defined in claim 2 wherein said upper and lower vacuum outlet headers are symmetrically positioned relative to the center of said load.

20. A vacuum drying system as defined in claim 1 wherein said vacuum drying system is a dielectric and includes a pair of horizontal opposed electrodes for applying dielectric power to said load.

21. A vacuum drying system as defined in claim 20 wherein each said header extends at least along 20% of a longitudinal length of said electrodes.

22. A vacuum drying system as defined in claim 21 wherein said at least two vacuum draw outlet headers comprises a first pair of upper and lower outlet headers on one longitudinal side of said load and a second pair of said upper and lower outlet headers on a second longitudinal side of load opposite said first longitudinal side.

23. A vacuum drying system as defined in claim 22 wherein said upper and lower vacuum outlets are symmetrically positioned relative to the center of said load.

24. A vacuum drying system as defined in claim 21 wherein said upper and lower vacuum outlets are symmetrically positioned relative to the center of said load.

25. A vacuum drying system as defined in claim 20 wherein each said header extends along at least 70% of said longitudinal length of said electrodes.

26. A vacuum drying system as defined in claim 25 wherein said at least two vacuum draw outlet headers comprises a first pair of upper and lower outlet headers on one longitudinal side of said load and a second pair of said upper and lower outlet headers on a second longitudinal side of load opposite said first longitudinal side.

27. A vacuum drying system as defined in claim 26 wherein said upper and lower vacuum outlets are symmetrically positioned relative to the center of said load.

28. A vacuum drying system as defined in claim 25 wherein each said upper outlet headers is positioned above an upper third of a distance separating said electrodes when said electrodes are in operative position for drying said load and each said lower outlet headers are positioned within a lower third of said distance separating said electrodes when said electrodes are in operative position.

29. A vacuum dying system as defined in claim 25 wherein said upper and lower vacuum outlets are symmetrically positioned relative to the center of said load.

30. A vacuum drying system as defined in claim 28 wherein said upper and lower vacuum outlets are symmetrically positioned relative to the center of said load.

31. A vacuum drying system as defined in claim 20 wherein said at least two vacuum draw outlet headers comprises a first pair of upper and lower outlet headers on one longitudinal side of said load and a second pair of said upper and lower outlet headers on a second longitudinal side of load opposite said first longitudinal side.

32. A vacuum drying system as defined in claim 31 wherein each said upper outlet headers is positioned within an upper third of a distance separating said electrodes when said electrodes are in operative position for drying said load and each said lower outlet headers are positioned within a lower third of said distance separating said electrodes when said electrodes are in operative position.

33. A vacuum drying system as defined in claim 31 wherein said upper and lower vacuum outlets are symmetrically positioned relative to the center of said load.

34. A vacuum drying system as defined in claim 32 wherein said upper and lower vacuum outlets are symmetrically positioned relative to the center of said load.

35. A vacuum drying system as defined in claim 20 wherein each said upper outlet headers is positioned within an upper third of a distance separating said electrodes when said electrodes are in operative position for drying said load and each said lower outlet headers are positioned within a lower third of said distance separating said electrodes when said electrodes are in operative position.

36. A vacuum drying system as defined in claim 35 wherein said upper and lower vacuum outlets are symmetrically positioned relative to the center of said load.

37. A vacuum drying system as defined in claim 20 wherein said upper and lower vacuum outlets are symmetrically positioned relative to the center of said load.

38. A vacuum drying system as defined in claim 1 wherein said at least two vacuum draw outlet headers comprises a first pair of upper and lower outlet headers on one longitudinal side of said load and a second pair of said upper and lower outlet headers on a second longitudinal side of load opposite said first longitudinal side.

39. A vacuum drying system as defined in claim 38 wherein said upper and lower vacuum outlets are symmetrically positioned relative to the center of said load.

40. A vacuum drying system as defined in claim 1 wherein said upper and lower vacuum outlet headers are symmetrically positioned relative to the center of said load.

* * * * *